US006198262B1

(12) United States Patent
Squibb et al.

(10) Patent No.: US 6,198,262 B1
(45) **Date of Patent: *Mar. 6, 2001**

(54) SELECTIVE DUAL INPUT LOW DROPOUT LINEAR REGULATOR

(75) Inventors: George F. Squibb; Mark R. Trace, both of Spring, TX (US)

(73) Assignee: Compaq Computer Corporation, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/196,871

(22) Filed: Nov. 20, 1998

(51) Int. Cl.[7] ..... G05F 1/40
(52) U.S. Cl. ..... 323/273

(58) Field of Search ..... 323/273, 280, 323/282, 351

(56) References Cited

U.S. PATENT DOCUMENTS 3,099,791 * 7/1963 Turner ..... 323/273
5,563,501 * 10/1996 Chan ..... 323/282
5,874,828 * 2/1999 Lee ..... 323/274

* cited by examiner

*Primary Examiner*—Adolf Berhane
(74) *Attorney, Agent, or Firm*—Fletcher, Yoder & Van Someren

(57) ABSTRACT

A circuit and method for controlling current drawn from two different voltage sources while maintaining regulation of a fixed output voltage during controlled switching of different sleep states required by the microprocessor and system board.

25 Claims, 3 Drawing Sheets

SELECTIVE DUAL INPUT LOW DROPOUT LINEAR REGULATOR

BACKGROUND AND SUMMARY OF THE INVENTION

The present invention relates to power supplies for personal computers and more particularly to low dropout linear regulators.

Background: PC Power Supplies

Many PC power supplies are of the same basic design. A typical topology is Constant Voltage Half-Bridge Forward Converting Switching power supplies, usually known simply as switching supplies. Constant voltage means that the output voltage is always the same as the current changes with changing power requirements. Half-Bridge Forward Converting is the type of switching design. The main advantages of these power supplies over other designs are their high efficiency, low heat dissipation, small size, and affordable prices.

While all PC power supplies operate in a similar manner, there can be wide variations in quality and performance. Standards certification, the manufacturer's reputation, and the following basic technical parameters are useful when testing, evaluating, and specifying a computer power supply.

AC Ripple, also known as PARD (periodic and random deviation) measures the root-mean-square RMS (average) voltage of all AC components on the DC output. This average number can be deceptive because it does not provide information on the presence of periodic switching spikes. RMS AC Ripple measurements should be accomplished by peak voltage measurements to assure switching spikes are not excessive (i.e., <200 mV).

Load regulation, more accurately called voltage load regulation, measures the output voltage change from minimum load (minimum current sourced) to maximum load (maximum current sourced). In general, the voltage tends to drop off as the current rises and Load Regulation is a negative number. In practice, power supply manufacturers rarely indicate whether regulation is positive or negative.

Line regulation, more accurately called voltage line regulation, measures the output voltage change from minimum AC input to maximum AC input. The typical 115VAC power supply is designed to accept an AC input ranging from 90VAC to 135VAC with little change in its DC outputs.

The Mean Time To Failure (MTTF) is a useful parameter to specify the quality of a system. The MTTF is the expected time that a system will operate before the first failure occurs. The MTTF is calculated by applying a mathematical formula to the individual component failure rates. A MTTF of 30,000 hours is fairly common for PC power supplies, equating to around 3.5 years of continuous use.

Efficiency is simply the ratio of output power to input power. For a computer power supply this ratio is usually between 65–85%; the other 15–35% being dissipated as heat during AC to DC conversion. Efficiency is important for a couple of reasons. First, the less heat dissipated, the better. Excessive heat can cause shortened lifecycles and induce poor system performance. Second, greater efficiency means money saved on electric bills. Often efficiency is a design choice; increased efficiency may sacrifice load regulation and other parameters.

A current and future consideration is the direction of the EPA's Energy Star Program. Presently, there are no specifications for power supplies, only for systems. For 'Green' certification, the computer, not including monitor, must not exceed 30 W of power consumption in the low-power (inactive) state. Efficient power supplies help computer makers meet 'Green' certification.

Background: Power Conservation and Battery Powered Endurance

There are three basic approaches to extending the battery powered endurance of a portable computer. The simplest way is to specify components at the lowest economical power consumption. Thus, for instance, CMOS integrated circuits and liquid crystal displays (LCDs) will normally be used. An equally simple way is to increase battery capacity. However, both of these routes rapidly encounter limits which are set simply by the tradeoff of the cost of lower-power components or of the elimination of functionality, with user expectations.

The third way is to use power-management algorithms so that, at almost every instant, all components are being operated in the lowest-power mode for their current demands. Thus, for example, a processor which is not currently executing a program may be placed into "sleep" mode, to reduce its overall power consumption. For another example, substantial power savings can be achieved simply by stopping the system clock (or by slowing down the system clock to a very low rate). For another example, it is common practice, in portable computers with an LCD display, to provide backlighting for use of the display under low-light conditions since this backlighting consumes relatively large amounts of power, it will normally be turned off after a short period of inactivity (or even, alternatively, after a short duration regardless of activity), until the user again demands backlighting.

All of these lines of approach have some inherent limits. For example, it is hard to foresee any integrated circuit technology which would be more economical and more power-efficient than low-power low-voltage CMOS being produced by the century's end. While some further improvement in this area is foreseeable, no revolutionary improvements appear likely. Moreover, in practice, such improvements are largely outside the control of system designers: when lower-power chips are sampled, system design houses will buy them; but system design houses cannot greatly accelerate the pace of introduction of such chips.

It is also true that the smartest power-management programs cannot reduce the time fraction during which the user wishes to look at the display, or enter data through the keyboard. However, in this area there does appear to be room for improvement, and system design improvements can help achieve power efficiency.

Many power management schemes have been proposed in which parts of the system are shut down during periods of inactivity. These approaches tend to extend the usable working time of the system between recharges. (One example of a portable computer system with power-monitoring functions is described in U.S. Pat. No. 4,980,836 to Carter et al., which is hereby incorporated by reference. Another source of proposed teachings regarding power-management functions is provided by the DS1227 product preview, contained in the 1988 data book of Dallas Semiconductor Corporation, which is also hereby incorporated by reference.)

In addition, it has been recognized that management of the charging and discharging cycles of Ni-Cd batteries can help to extend their life.

Either of these power-management functions requires some intelligent control. The conventional way to implement control mechanisms has been using the main microprocessor (CPU). The necessary control program steps are inserted into the BIOS software (basic input/output system software), which is stored in ROM.

Background: Sleep Mode

Laptop computer systems will typically have an automatic power-down function. Since some of the components use significant power, even when no computation or input is occurring, the system will send itself into a standby or sleep mode if the user has not provided any input for a given period of time (e.g., 30 seconds or five minutes). (Sleep mode may not normally be entered, however, if new information is still being written to the display.)

There are various enhancements which have been proposed to the scheme. For example, it may be desirable to blank the display after a certain length of inactivity and shut down the system clock only after an additional length of inactivity.

Thus, there may be more than one reduced-power mode. For example, a "standby" mode may be used to transiently power-down subsystems (such as the display or the hard disk) without stopping the CPU. For deeper inactivity, a "sleep" mode can also be entered, in which nearly all functions of the system arc turned off. From the standpoint of power consumption, entering sleep mode is almost the same as turning a conventional nonportable machine off (except that data will not be lost).

Background: Low Dropout Linear Regulators

A previous method of low dropout linear regulation implementation is depicted in FIG. 4. In the embodiment shown, a dual source control scheme is implemented by means of a small regulator and power MOSFET switch. The small regulator (PQ3TZ53) provides the stand-by current of 0.5 amperes for the stand-by 3.3 Volt aux. The FET switch controls the high current from the main 3.3 Volt.

The timing of "turn on" of the power supply, how the main voltages start up, and how soon the current is drawn from the 3.3 Volt dual is difficult to manage independent of the power supply. To do so, an RC time constant off the main 12 Volts is used. The DC logic signal to turn on the supply is an asynchronous signal with delays in the supply of up to 0.5 seconds.

In addition, the load transition at the 3.3 Volt dual output from 0.5 Amperes to 7 Amperes depends greatly on the system timing of the loads. Digital signals "A" and "B" need to be generated to facilitate this change over the load currents.

The problem faced by all designers of power supplies is making transitions between the various sleep states. Use of many different power supply architectures causes problems with logic transitions. It is critical to maintain voltage regulation through all of the variations of these architectures and outside vendors.

Selective Dual Input Low Dropout Liner Regulator

A method of and device for controlling current drawn from two different voltage sources. Regulation of a fixed output voltage during controlled switching of different sleep states required by the microprocessor and system board is also maintained. In one example of the innovative teachings contained herein, one P channel MOSFET controls regulation of the output voltage under all transitional states. It is basically an extremely low voltage input linear regulator. It provides both standby 2.5 Volt and main 2.5 Volt depending on the load current needed and the Sleep State of the machine. Current drawn from the two input sources is controlled by the use of the two different diode technologies rather than using an active switching mechanism. In one novel embodiment, the heavy load current is drawn from the main 3.3 Volt, whereas the standby current is drawn from the 3.3 Volt aux. For heavy load current a Schottky diode with a low forward voltage is used. For the light load case the current is drawn through a normal P/N junction diode (having an inherently higher voltage drop). These two diodes control current draw from the proper source by virtue of their different forward voltage drops. These different voltage drops are the keys to the automatic operation of the regulator.

The disclosed innovations, in various embodiments, provide one or more of at least the following advantages: no timing is required from the host system; current draw from the two input sources is controlled so that heavy loading on the aux is not allowed; and there are no timing problems as the system transitions from the various sleep states of the system.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation), in which:

Definitions

Following is a list of definitions which may be helpful in understanding the innovative teachings of the present application:

Diode: A two-terminal electronic device that will conduct electricity much more easily in one direction than in the other.

Field-Effect Transistor (FET): A three-terminal device in which current between two current-carrying electrodes ("Source" and "drain") is controlled by the voltage applied to a "gate" terminal.

Junction: An interface between p-type and n-type semiconductor material.

Junction Diode: A two-terminal device containing a single crystal of semiconducting material with p-type material at one terminal and n-type material at the other. It conducts current more easily in one direction than in the other.

N-type: A volume of semiconductor which normally includes an excess of electrons. This can be achieved by introduction of "donor" dopants (such as phosphorus, arsenic, or antimony in silicon).

P-type: A volume of semiconductor which normally includes an excess of holes. This can be achieved by introduction of "acceptor" dopants (such as boron or gallium in silicon).

Schottky Diode: A junction diode with the junction formed between the semiconductor and a metal contact rather than between dissimilar semiconductor materials, as in the case of an ordinary pn diode.

Shunt Regulator: A device placed across the output of a regulated power supply to control the current through a series-dropping resistance in order to maintain a constant output voltage or current.

Voltage Regulator: A circuit that holds an output voltage at a predetermined value or causes it to vary according to a predetermined plan, regardless of normal input-voltage changes or changes in the load impedance.

Presently Preferred Embodiment

Figure 1:
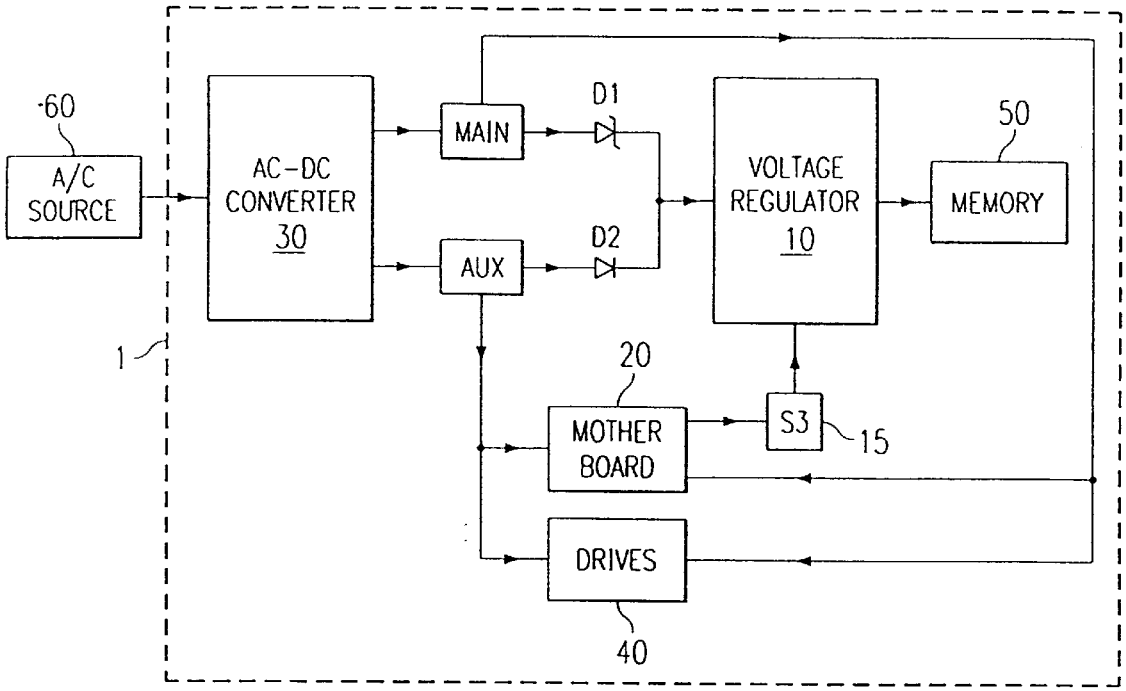
FIG. 1 shows a block diagram of the disclosed voltage regulator in combination with a computer.

FIG. 1 shows a block diagram of the disclosed voltage regulator in combination with other components of a computer 1. In a presently preferred embodiment, an AC to DC converter 30 receives an input from an AC power source 60. The AC to DC converter 30 has at least two outputs. One of these outputs is a high current main power output MAIN. Another of these outputs is a low current auxiliary power output AUX. The main power supply MAIN and the auxiliary power supply AUX also supply power to other components of the computer other than $D_1$ and $D_2$. These components include such devices as a mother board 20 and disk drives 40. (Other circuit components which may be needed to connect the power supplies MAIN and AUX with the other components 20 and 40 are not shown.)

Two passive devices, diodes $D_1$ and $D_2$ are used to switch between a main power supply MAIN and an auxiliary power supply AUX use to supply power to memory devices 50. Both sleep state S3 and global state G3 are global system states which will be described below. The cathodes of the diodes $D_1$ and $D_2$ are connected to a voltage regulator 10 which maintains the output voltage to a memory device 50 at a substantially constant value. The auxiliary power AUX is always on except when the computer is in global state G3. The main power supply MAIN is turned on or off by signals received from the computer 1. When no output voltage is needed for the portion of the computer to which this voltage regulator supplies power to, sleep state S3 15 is turned on. External state S3 triggers the voltage regulator 10 to have a zero voltage output 20. When the sleep state S3 15 is off, the voltage regulator runs in a normal mode maintaining a substantially constant voltage to the output 20. Whether sleep state S3 15 is on or off is determined by the requirements of the computer 1.

Current drawn from the two input sources, MAIN and AUX, is controlled by the use of the two different diode technologies. The heavy load current is drawn from the main power supply MAIN, whereas the standby current is drawn from the auxiliary power supply AUX. For heavy load current, a Schottky diode, $D_1$, with a low forward voltage is used. For the light load case, the current is drawn through a normal P/N junction diode, $D_2$, having a higher voltage drop. These two diodes control current draw from the proper source by virtue of their different forward voltage drops. These different voltage drops are the keys to the automatic operation of the regulator. There is no requirement that the main power supply MAIN and the auxiliary power supply AUX have exactly equal voltages. However, the two power supplies MAIN and AUX should not have voltages which are too dissimilar. For example, a 5V main power supply MAIN should not be coupled with a 3.3V auxiliary power supply AUX.

Selective Dual Input Lowdrop Linear Regulator: 3.3V to 2.5V

Figure 2:
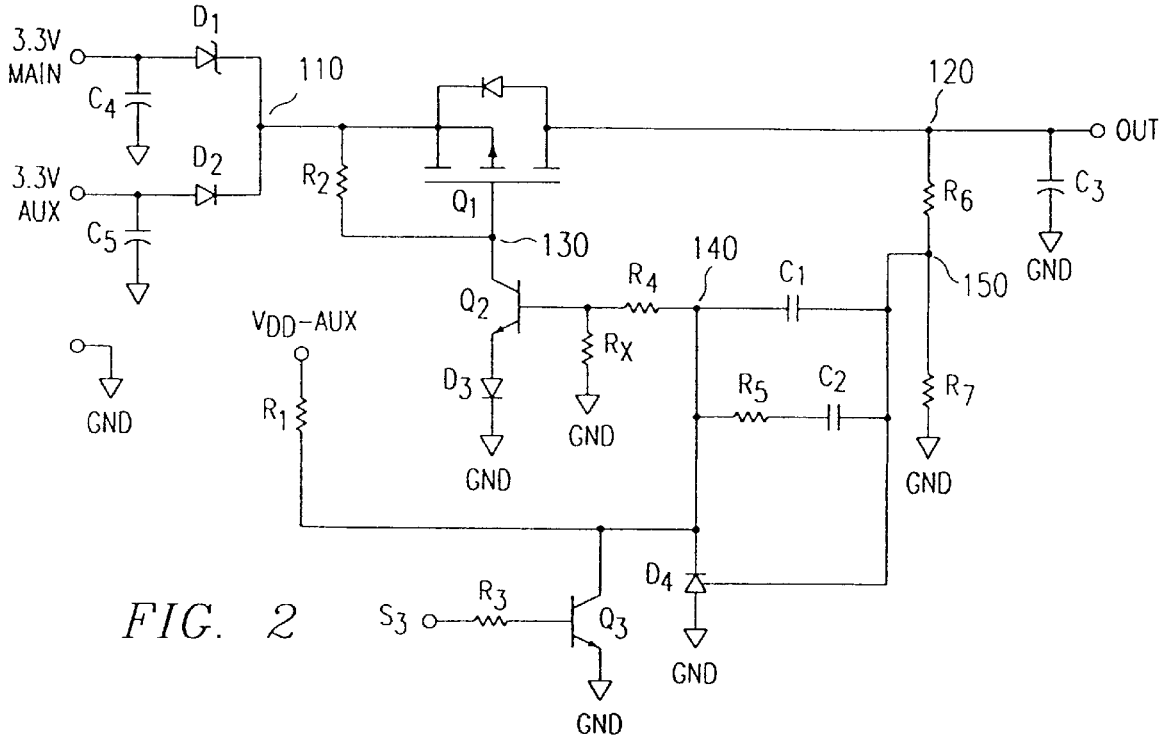
FIG. 2 shows a circuit diagram of a 3.3V to 2.5V voltage regulator.

In one example, which will be described primarily with reference to FIG. 2, the selective dual input lowdrop linear regulator has a main power input MAIN and an auxiliary power input AUX. The main power input MAIN (in the present example, a 3.3V source) is connected to a the anode of a Schottky diode $D_1$ (preferably 3 amp in the present example) which has its cathode connected to node 110. The auxiliary power input AUX (in the present example, a 3.3V source) is connected to the anode of a junction diode $D_2$ (preferably a 1 A diode in the present example) which also has its cathode connected to node 110. A resistor $R_1$ (with a presently preferred value of around 1 kΩ) is connected between the 5V auxiliary power node $V_{dd}$-AUX and node 140. A capacitor $C_4$ (preferably having a value greater than 15 μF) has a first terminal connected to the main power input MAIN and a second terminal connected to ground GND. Another capacitor $C_5$ (preferably having a value of 4.7 μF) has a first terminal connected to the auxiliary power input AUX and a second terminal connect to ground GND.

A resistor $R_2$ (with a presently preferred resistance of around 1 kΩ) has a first terminal connected to node 110 and a second terminal connected to node 130. A switch $Q_1$ has a source connected to node 110, a drain connected to node 120, and a gate connected to node 130. In the present example, the switch $Q_1$ is an insulated gate field effect transistor (MOSFET) (with its source tied to its drain via a diode and its body tied to its source). Switch $Q_1$ has its source connected to node 110, its drain connected to node 120, and its gate connected to node 130. An example of a transistor appropriate for this function is the Fairchild NDB6020P.

A bipolar transistor $Q_2$ has its collector connected to node 130 and its base connected to a first terminal of a resistor $R_4$ (preferably a 2.2 kΩ resistor) which then has a second terminal connected to node 140. A resistor $R_x$ (preferably with a value of 1.5 kΩ) has a first terminal connected to the base of transistor $Q_2$ and a second terminal connected to ground GND. The resistor $R_x$ helps control the gain of transistor $Q_2$ stage and sets the DC bias for $Q_2$. The emitter of transistor $Q_2$ is connected to the anode of a junction diode $D_3$ (preferably a 1N4148 p/n junction type diode with a current rating around 10 mA) which has its cathode connected to ground GND. A capacitor $C_1$ (preferably with a capacitance of around 0.027 μF) has a first terminal connected to node 140 and a second terminal connected to node 150. Capacitor $C_1$ is in parallel with a resistor $R_5$ (preferably a 300Ω resistor with 1% tolerance) and a capacitor $C_2$ (preferably a 0.12 μF capacitor). Resistor $R_5$ has a first terminal connected to node 140 and a second terminal connected to a first terminal of a capacitor $C_2$. Capacitor $C_2$ has a second terminal connected to node 150.

There is a resistor $R_6$ (preferably with a resistance of around 1.21 kΩ with a tolerance of around 1%) which has a first terminal connected to node 120 and a second terminal connected to node 150. There is another resistor $R_7$ (preferably with a resistance of around 1.21 kΩ with a tolerance of around 1%) which has a first terminal connected to node 150 and a second terminal connected to ground GND. A capacitor $C_3$ (preferably a 150 $\mu$F capacitor) has a first terminal connected to node 120 and a second terminal connected to ground GND. Resistor $R_3$ has a first terminal connected to a sleep state input S3 and a second terminal connected to the base of a bipolar transistor $Q_3$ (an example of an appropriate transistor is a 2N2222A transistor). The emitter of transistor $Q_3$ is connected to ground GND while the collector of transistor $Q_3$ is connected to node 140. A shunt regulator $D_4$ (preferably a 2.5V TL431 shunt regulator) has its anode connected to ground GND, its cathode connected to node 140, and its gate connected to node 150.

In this circuit, the auxiliary power AUX is always on except when the computer is in global state G3. Sleep state S3 turns off the switch $Q_1$ so that there is no voltage at the output, but the auxiliary power is still on. The main power is turned on and off external to this circuit.

Current drawn from the two input sources is controlled by the use of the two different diode technologies. The heavy load current is drawn from the main 3.3 Volt, whereas the standby current is drawn from the 3.3 Volt aux. For heavy load current a Schottky diode $D_1$ with a low for ward voltage is used. For the light load case the current is drawn through a normal PIN junction diode $D_2$ having a higher voltage drop. These two diodes control current draw from the proper source by virtue of their different forward voltage drops. These different voltage drops are the keys to the automatic operation of the regulator.

Sleep State S3 requires that the 2.5vs3 regulator be turned off entirely. Q3 and R3 handle that function.

Regulation control of the 2.5 Volt output OUT is accomplished by a TLV431 shunt regulator $D_4$ used here as an error amplifier. Components R6, R7, C1, C2, R4, R5, Q2, D3, R1, and R2 provide the normal regulation and compensation of the regulator. C3 is used for output stability and transient response.

Selective Dual Input Lowdrop Linear Regulator: 5.0 to 3.3V

Figure 3:
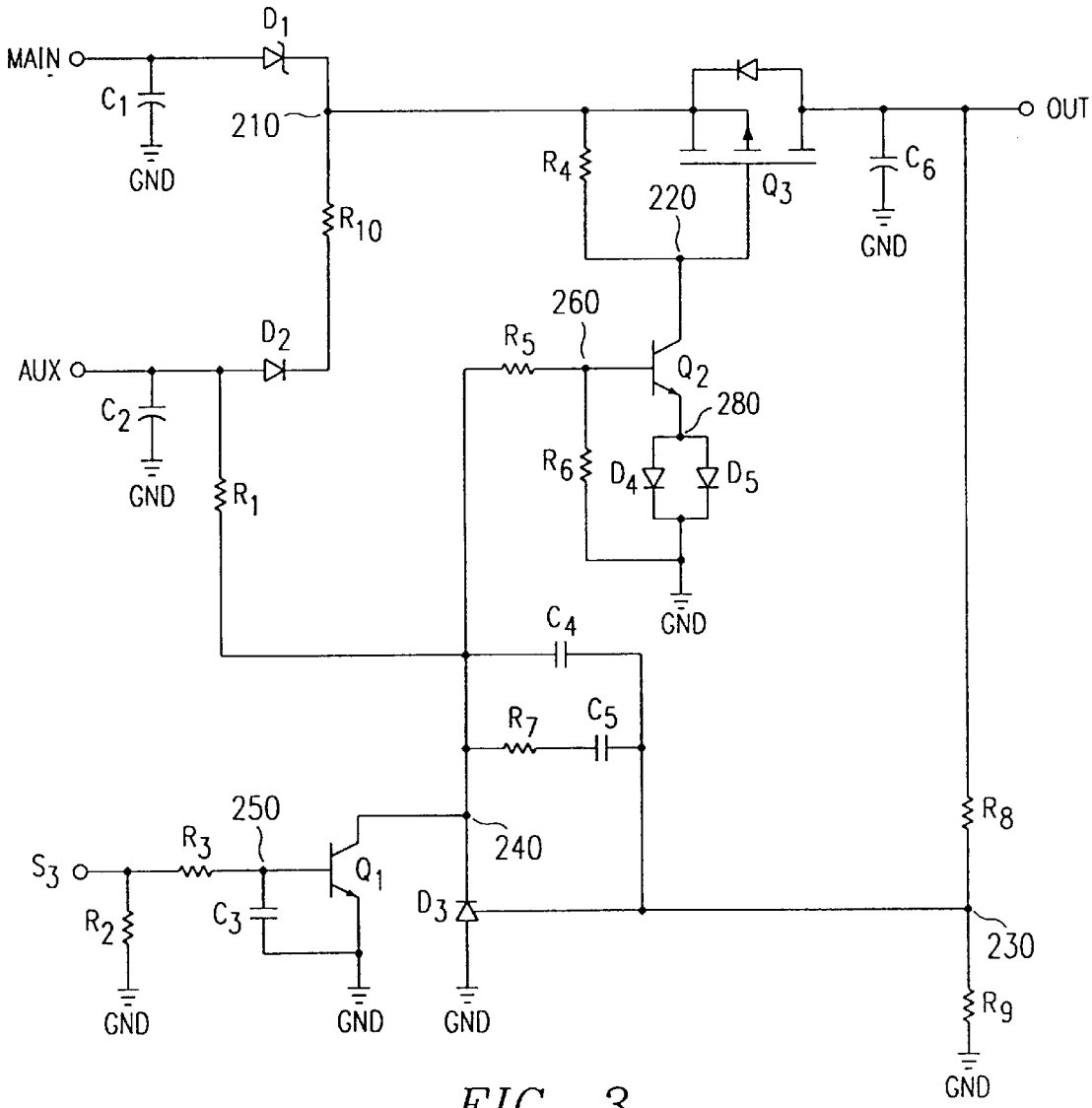
FIG. 3 shows a circuit diagram of a 5V to 3.3V voltage regulator.
Figure 4:
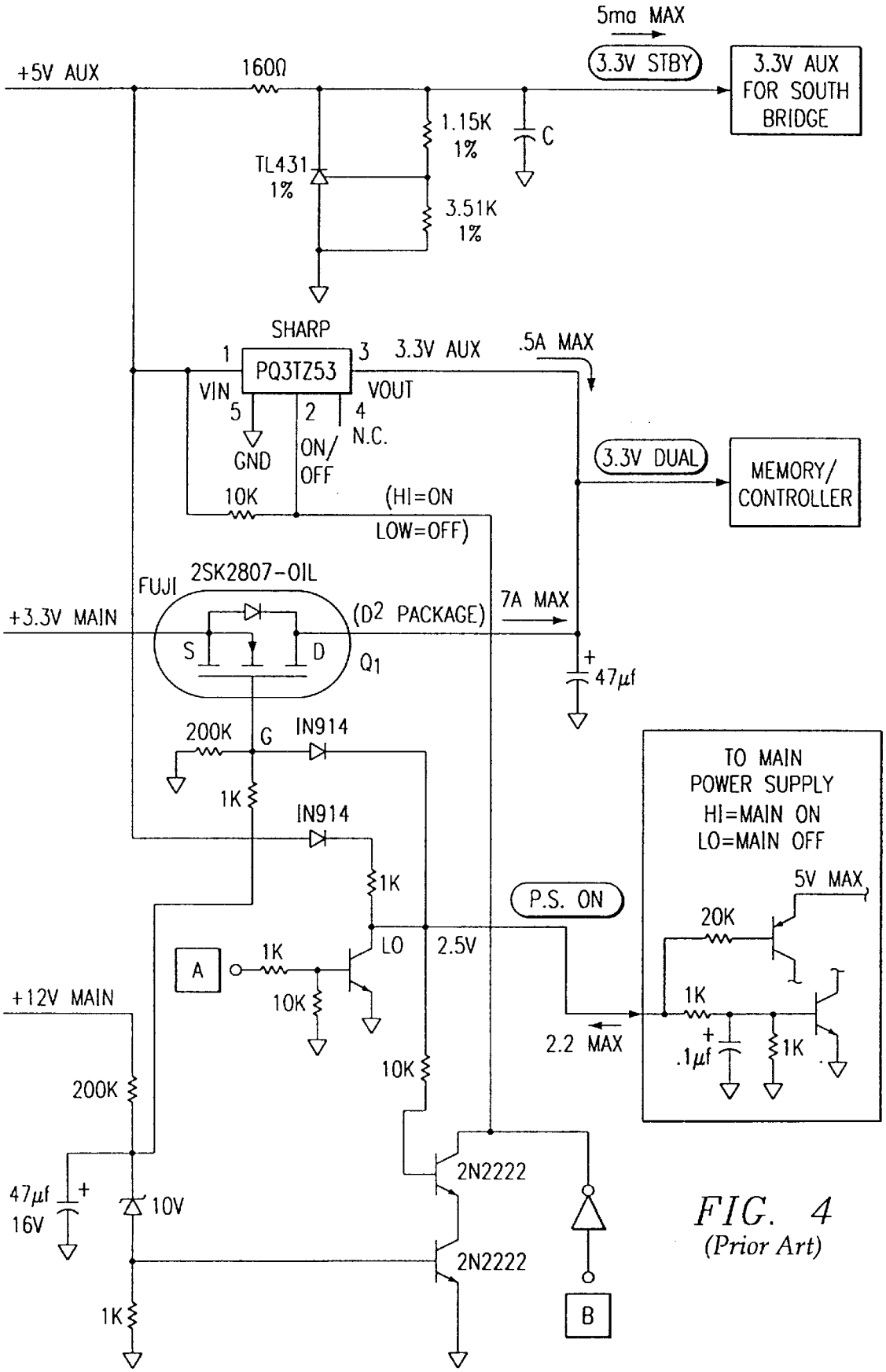
FIG. 4 (Prior Art)
FIG. 4 shows a circuit diagram of a previous voltage regulator.

In another example, output voltage is regulated at 3.3V from an input voltage of 5V. Referring to FIG. 3, a capacitor $C_1$ (preferably with a value greater than or equal to 15 $\mu$F) has a first terminal connected to ground GM) and a second terminal connected to the main power supply MAIN. Both the main power supply MAIN and the auxiliary power supply AUX should be around 5V. Another capacitor $C_2$ preferably with a value of around 4.7 $\mu$F) has a first terminal connected to ground GND and a second terminal connected to the auxiliary power supply AUX. The anode of diode $D_1$ (preferably a 3 A Schottky an example of which is a MBRS340) is connected to the main power supply MAIN and the cathode of diode $D_1$ is connected to node 210. The anode of diode $D_2$ (preferably a 1 A P/N junction diode an example of which is a MUR120) is connected to the auxiliary power supply and the cathode of diode $D_2$ is connected to a first terminal of resistor $R_{10}$ (preferably with a value of 10Ω). The second terminal of resistor $R_{10}$ is connected to node 210. A first terminal of resistor $R_1$ (preferably with a value of 1 kΩ) is connected to the auxiliary power supply AUX and the second terminal of resistor $R_1$ is connected to node 240. A first terminal of resistor $R_4$ (preferably with a value of 1 kΩ) is connected to node 210 and a second terminal of resistor $R_4$ is connected to node 220. A MOSFET $Q_3$ (preferably a model number NDP6020P transistor) has its source connected to node 210, its drain connected to the output OUT, and its gate connected to node 220. A capacitor $C_6$ (preferably with a value of 150 $\mu$F) has a first terminal connected to the output OUT and a second terminal connected to ground GND. A bipolar transistor $Q_2$ (preferably a model number 2N2222A transistor) has its collector connected to node 220, its emitter connected to node 280, and its base connected to node 260. A resistor $R_6$ ( preferably with a value of 1.5 kΩ) has a first terminal connected to node 260 and a second terminal connected to ground GND. A junction diode $D_4$ has its anode connected to node 280 and its cathode connected to ground GND. Another junction diode $D_5$ is in parallel with junction diode $D_4$. Junction diode $D_5$ also has its anode connected to node 280 and its cathode connected to ground GND. In the present example, $D_4$ and $D_5$ are combined into a dual diode, an example of which is an S0T223.

A resistor $R_5$ (preferably with a value of 2.2 kΩ) has a first terminal connected to node 260 and a second terminal connected to node 240. A capacitor $C_4$ (preferably with a value 0.027 $\mu$F) has a first terminal connected to node 240 and a second terminal connected to node 230. A resistor $R_7$ (preferably with a value of 300Ω) has a first terminal connected to node 240 and a second terminal connected to a first terminal of capacitor $C_5$ (preferably with a value of 0.12 $\mu$F). The second terminal of capacitor $C_5$ is connected to node 230. A resistor $R_5$ (preferably with a value of 1.21 kΩ and a tolerance of 1%) has a first terminal connected to the output OUT and a second terminal connected to node 230. A resistor $R_9$ (preferably with a value of 1.21 kΩ and a tolerance of 1%) has a first terminal connected to node 230 and a second terminal connected to ground GND. A shunt regulator $D_3$ (preferably a 2.5V shunt regulator, an example of which is a TL431) has its anode connected to ground, its cathode connected to node 240, and its reference connected to node 230. A bipolar transistor $Q_1$ (preferably a model number 2N2222A transistor) has its emitter connected to ground GND, its collector connected to node 240, and its base connected to node 250. A capacitor $C_3$ (preferably with a value of 0.1 $\mu$F) has a first terminal connected to node 250 and a second terminal connected to ground GND. A resistor $R_3$ (preferably with a value of 2.2 kΩ) has a first terminal connected to node 250 and a second terminal connected to sleep input S3. A resistor $R_2$ (preferably with a value of 8.2 kΩ) has a first terminal connected to sleep input S3 and a second terminal connected to ground GND.

Global System States

Global system states (G0–G3) apply to the entire system and are visible to the user. Global system states are defined by six principal criteria:

Does application software run?

What is the latency from external events to application response?

What is the power consumption?

Is an operating system (OS) reboot required to return to a working state?

Is it safe to disassemble the computer?

Can the state be entered and exited electronically?

The following is a list of the system states:

G3—Mechanical Off: A computer state that is entered and left by a mechanical means (e.g., turning off the system's power through the movement of a large red switch). This operating mode is required by various government agencies and countries. It is implied by the entry of this off state through a mechanical means that no electrical current is running through the circuitry and it can be worked on without damaging the hardware or endangering service personnel. The OS must be restarted to return to the Working state. No hardware context is retained. Except for the real time clock, power consumption is zero.

G1—Sleeping: A computer state where the computer consumes a small amount of power, user mode threads are not being executed, and the system "appears" to be off (from an end user's perspective, the display is off, etc.). Latency for returning to the Working state G0 varies depending upon the wakeup environment selected prior to entry of this state (for example, should the system answer phone calls, etc.). Work can be resumed without rebooting the OS because large elements of system context are saved by the hardware and the rest by system software. It is not safe to disassemble the machine in this state.

G2/S5—Soft Off: A computer state where the computer consumes a minimal amount of power. No user mode or system mode code is run. This state requires a large latency in order to return to the Working state. The system's context will not be preserved by the hardware. The system must be restarted to return to the Working state. It is not safe to disassemble the machine in this state.

G0—Working: A computer state where the system dispatches user mode (application) threads and they execute. In this state, devices (peripherals) are dynamically having their power state changed. The user will be able to select (through some user interface) various performance/power characteristics of the system to have the software optimize for performance of battery life. The system responds to external events in real time. It is not safe to disassemble the machine in this state.

S4—Non-Volatile Sleep: S4 Non-Volatile Sleep (NVS) is a special global system state that allows system context to be saved and restored (relatively slowly) when power is lost to the motherboard. If the system has been commanded to enter S4, the OS will write all system context to a non-volatile storage file and leave appropriate context markers. The machine will then enter the S4 state. When the system leaves the Soft Off or Mechanical Off state, transitioning to Working (G0) and restarting the OS, a restore from a NVS file can occur. This will only happen if a valid NVS data set is found, certain aspects of the configuration of the machine have not changed, and the user has not manually aborted the restore. If all these conditions are met, as part of the OS restarting it will reload the system context and activate it. The net effect for the user is what looks like a resume from a Sleeping (G1) state (albeit slower). The aspects of the machine configuration that must not change include, but are not limited to, disk layout and memory size. It might be possible for the user to swap a PC Card or a Device Bay device, however.

Note that for the machine to transition directly from the Soft Off or Sleeping states to S4, the system context must be written to non-volatile storage by the hardware; entering the Working state first so the OS or BIOS can save the system context takes too long from the user's point of view. The transition from Mechanical Off to S4 is likely to be done when the user is not there to see it.

Because the S4 state relies only on non-volatile storage, a machine can save its system context for an arbitrary period of time (on the order of many years).

Sleeping states S1–S4 are types of sleeping states within the global sleeping state, G1.

S1 Sleeping State: The S1 sleeping state is a low wake-up latency sleeping state. In this state, no system context is lost (CPU or chip set) and hardware maintains all system context.

S2 Sleeping State: The S2 sleeping state is a low wake-up latency sleeping state. This state is similar to the S1 sleeping state except the CPU and system cache context is lost (the OS is responsible for maintaining the caches and CPU context). Control starts from the processor's reset vector after the wake-up event.

S3 Sleeping State: The S3 sleeping state is a low wake-up latency sleeping state where all system context is lost except system memory. CPU, cache, and chip set context are lost in this state. Hardware maintains memory context and restores some CPU and L2 configuration context. Control starts from the processor's reset vector after the wake-up event.

S4 Sleeping State: The S4 sleeping state is the lowest power, longest wake-up latency sleeping state supported by ACPI. In order to reduce power to a minimum, it is assumed that the hardware platform has powered off all devices. Platform context is maintained.

S5 Soft Off State: Sleeping state S5 is a type of sleeping state within the global Soft Off state, G2. The S5 state is similar to the S4 state except the OS does not save any context nor enable any devices to wake the system. The system is in the "soft" off state and requires a complete boot when awakened. Software uses a different state value to distinguish between the S5 state and the S4 state to allow for initial boot operations within the BIOS to distinguish whether or not the boot is going to wake from a saved memory image.

According to a disclosed class of innovative embodiments, there is provided: A power-supply circuit, comprising: first and second diodes, each separately connected to a respective power input which is substantially DC; and a regulator connected to draw power through either of said diodes, and configured to provide a regulated power output.

According to another disclosed class of innovative embodiments, there is provided: A voltage regulating circuit, comprising: first and second diodes, each separately connected to a respective power input which is substantially DC; an error amplifier; a regulating circuit to provide a substantially constant output voltage; a switch to turn said regulating circuit on and off; and a capacitor to provide output stability and transient response.

According to another disclosed class of innovative embodiments, there is provided: A computer system, comprising: a processor; a power supply; wherein said power supply comprises: first and second diodes, each separately connected to a respective power input which is substantially DC; said diodes being implemented in different device technologies; and a regulator connected to draw power through either of said diodes, and configured to provide a regulated power output.

According to another disclosed class of innovative embodiments, there is provided: A method for regulating power output, comprising: providing a first input voltage and a second input voltage; regulating said input voltages to provide a substantially constant output voltage without active switching between said first input voltage and said second input voltage; switching said output voltage between a non-zero voltage and a zero voltage; wherein said switching occurs in response to an outside stimulus; whereby switching occurs as a result of a state change in a machine.

The following background publications provide additional detail regarding possible implementations of the disclosed embodiments, and of modifications and variations thereof. All of these publications are hereby incorporated by reference: A wide variety of converter topologies have been proposed. See generally Pressman, SWITCHING POWER SUPPLY DESIGN (1991); the 3 volumes of Middlebrook and Ćuk, ADVANCES IN SWITCHED-MODE POWER CONVERSION (2.ed.1983); and all of the biennial UNITRODE POWER SUPPLY DESIGN SEMINAR HANDBOOKS; all of which are hereby incorporated by reference. Other references for background in this and related areas include the following: Billings, SWITCHMODE POWER SUPPLY HANDBOOK (1989); Chetty, SWITCHMODE POWER SUPPLY DESIGN (1986); Chryssis, HIGH FREQUENCY SWITCHING POWER SUPPLIES (2.ed.1989); Flanagan, HANDBOOK OF TRANSFORMER DESIGN & APPLICATIONS (2.ed.1993); Gottlieb, POWER SUPPLIES, SWITCHING REGULATORS, INVERTERS, AND CONVERTERS (2.ed.1994); Hoft, SEMICONDUCTOR POWER ELECTRONICS (1986); Lenk, SIMPLIFIED DESIGN OF SWITCHING POWER SUPPLIES (1995); Mazda, POWER ELECTRONICS HANDBOOK (1990); Mohan et al., POWER ELECTRONICS (2.ed.1995); Nasar, ELECTRIC MACHINES AND TRANSFORMERS (1984); Nave, POWER LINE FILTER DESIGN FOR SWITCHED-MODE POWER SUPPLIES (1991); REACTIVE POWER: BASICS, PROBLEMS AND SOLUTIONS (ed.Sheble 1987); Severns and Bloom, MODERN DC-TO-DC SWITCHMODE POWER CONVERTER CIRCUITS (1984); Shepard, POWER SUPPLIES (1984); Sum, SWITCH MODE POWER CONVERSION (1988); Tihanyi, ELECTROMAGNETIC COMPATIBILITY IN POWER ELECTRONICS (1995); Williams, POWER ELECTRONICS (1987); Wood, SWITCHING POWER CONVERTERS (1981); the proceedings of the annual INTERNATIONAL HIGH-FREQUENCY POWER CONVERSION conferences from 1986 to date; and the proceedings of the POWERCON and POWER ELECTRONICS SPECIALISTS conferences from 1980 to date. All of these books, and the references cited in them, are hereby incorporated by reference.

Modifications and Variations

As will be recognized by those skilled in the art, that although the innovative teachings of the present application have been described primarily in relation to a computer power supply, the innovative concepts described in the present application can be modified and varied over a tremendous range of applications and accordingly the scope of patented subject matter is not limited by any of the specific exemplary teachings given.

It should be noted that although the innovative teachings of the present application have been described primarily with respect to two inputs, but more than two inputs could be utilized as well. Furthermore, if $R_{10}$ in FIG. 3 were to be of a different size, then the automatic control could be extended to different values for the input voltages MAIN and AUX (e.g., 3V and 5V inputs). Alternatively, a resistor could be added in series with $D_1$ to produce this same effect.

What is claimed is:

1. A power-supply circuit, comprising:

a first diode connected to a first power input to receive power from a first DC power source during a first mode of operation;

a second diode connected to a second power input to receive power from a second DC power source during a second mode of operation, the second mode of operation being a lower power mode relative to the first mode of operation; and a regulator connected to draw power through either of said diodes, and configured to provide a regulated power output, wherein the first diode has a first forward voltage drop, and the second diode has a second forward voltage drop that is less than the first forward voltage drop, such that the regulator draws power through the first diode during the first mode of operation and draws power through the second diode during the second mode of operation.

2. The power-supply circuit of claim 1, wherein said regulator is a linear regulator.

3. The power-supply circuit of claim 1, wherein said regulator includes a MOSFET connected between said diodes and said power output, and a control circuit which is connected to operate said MOSFET in accordance with voltage at said power output.

4. The power-supply circuit of claim 1, wherein said power inputs have substantially equal voltages.

5. The power-supply circuit of claim 1, wherein said first and second diodes have different forward voltage drops.

6. The power-supply circuit of claim 1, wherein said diodes are implemented in different device technologies.

7. The power-supply circuit of claim 1, wherein said first diode is a Schottky diode.

8. The power-supply circuit of claim 1, wherein said second diode is a normal P/N junction diode.

9. A voltage regulating circuit, comprising:

a first diode connected to a first power input to receive power from a first DC power source during a first mode of operation;

a second diode connected to a second power input to receive power from a second DC power source during a second mode of operation, the second mode of operation being a lower power mode relative to the first mode of operation;

an error amplifier;

a regulating circuit to provide a substantially constant output voltage;

a switch to turn said regulating circuit on and off; and a capacitor to provide output stability and transient response.

10. The voltage regulating circuit of claim 9, wherein said regulating circuit is a linear regulator.

11. The voltage regulating circuit of claim 9, wherein said diodes are implemented in different device technologies.

12. The voltage regulating circuit of claim 9, wherein said first and second diodes have different forward voltage drops.

13. The voltage regulating circuit of claim 9, wherein said power inputs have substantially equal voltages.

14. The voltage regulating circuit of claim 9, wherein said first diode is a Schottky diode.

15. The voltage regulating circuit of claim 9, wherein said second diode is a normal P/N junction diode.

16. A computer system, comprising:

a processor; and a power supply operatively coupled to the processor and comprising:

a first diode connected to a first power input to receive power from a first DC power source during a first mode of operation;

a second diode connected to a second power input to receive power from a second DC power source during a second mode of operation, the second mode of operation being a lower power mode relative to the first mode of operation; and a regulator connected to draw power through either of said diodes, and configured to provide a regulated power output, wherein the first diode has a first forward voltage drop, and the second diode has a second forward voltage drop that is less than the first forward voltage drop, such that the regulator draws power through the first diode during the first mode of operation and draws power through the second diode during the second mode of operation.

17. The computer system of claim 16, wherein said regulator is a linear regulator.

18. The computer system of claim 16, wherein said regulator includes a switch connected between said diodes and said power output, and a control circuit which is connected to operate said switch in accordance with voltage at said power output.

19. The computer system of claim 16, wherein said power inputs have substantially equal voltages.

20. The computer system of claim 16, wherein said first and second diodes have different forward voltage drops.

21. The computer system of claim 16, wherein said diodes are implemented in different device technologies.

22. The computer system of claim 16, wherein said first diode is a Schottky diode.

23. The computer system of claim 16, wherein said second diode is a junction diode.

24. A method for regulating power output, comprising:

providing a first power input to a first diode, the first power input producing a first current;

providing a second power input to a second diode, the second diode being different from the first diode, and the second power input producing a second current;

providing a first current path from the first power input to a regulating circuit configured to provide a substantially constant output voltage;

providing a second current path from the second power input to the regulating circuit;

controlling the current flow into the regulating circuit without active switching between the first current path and the second current path;

switching said output voltage between a non-zero voltage and a zero voltage;

wherein said switching occurs in response to an outside stimulus; and whereby switching occurs as a result of a state change in a machine.

25. The method of claim 24, wherein said second input voltage may be non-zero when said output voltage is zero.

* * * * *